US005660913A

United States Patent [19]

Coppage, Jr.

[11] Patent Number: 5,660,913

[45] Date of Patent: Aug. 26, 1997

[54] ANTI-BALLISTIC PROTECTIVE COMPOSITE FABRIC

[75] Inventor: Edward A. Coppage, Jr., Oakton, Va.

[73] Assignee: Safariland, Inc., Ontario, Calif.

[21] Appl. No.: 571,474

[22] Filed: Dec. 13, 1995

[51] Int. Cl.[6] ..... B32B 3/06

[52] U.S. Cl. ..... 428/102; 428/219; 428/911; 442/247

[58] Field of Search ..... 428/246, 284, 428/286, 219, 911, 102

[56] References Cited

U.S. PATENT DOCUMENTS 4,737,402 4/1988 Harpell et al. ..... 428/252

5,343,796 9/1994 Cordova et al. ..... 89/36.02

5,395,671 3/1995 Coppage, Jr. et al. ..... 428/102

*Primary Examiner*—Christopher Raimund

*Attorney, Agent, or Firm*—Michael G. Gilman

[57] ABSTRACT

A composite fabric having inner and outer layers and a middle layer therebetween is disclosed. The inner and outer layers may be the same or different and each layer is made up of a plurality of sub-layers. The individual sub-layers are resin bonded substantially unidirectional anti-ballistic non-woven fibers. The same or a different number of sub-layers may be used as the inner and outer layers, respectively. The middle layer is made up of a plurality of woven fabric sub-layers. Each sub-layer is a woven fabric, comprising anti-ballistic fibers or yarns, which has been calendared to an extent sufficient to flatten the sub-layer fabric and to spread the fibers of the woven yarns into the void spaces created by the weaving.

13 Claims, No Drawings

ANTI-BALLISTIC PROTECTIVE COMPOSITE FABRIC

This invention relates to a novel composite fabric for use in protecting objects, notably the human body, against the penetration thereinto of incoming high energy, ballistic projectiles. This is commonly referred to as a bullet-proof vest. It more particularly refers to a novel, very lightweight, fabric which will offer protection which satisfies the N.I.J IIIA 9 mm test round fired from a sub-machine gun and lesser threats.

BACKGROUND OF THE INVENTION

Body armor has been around for a long time. In general, the desire is to make the body armor as light and as breathable as possible and still withstand the impact of incoming projectiles. In recent years, some body armor has been made from a woven and/or a non-woven fabric comprising filaments of very high molecular weight polymers, suitably polyolefin, such as polyethylene or high molecular weight polypropylene, and aramid polymers. Reference is here made to U.S. Pat. No. 4,737,402 in the name of Harpell et al. which has an excellent discussion of the chemical nature of these filaments which have been found to be well suited to use in protective fabrics. The entire contents of this patent are hereby incorporated herein by reference. The object of these fabrics is to cause the incoming ballistic projectile to expend its energy breaking the filaments of the fabric, and therefore lose its impetus to penetrate into the body being protected by the fabric.

It had recently been found, see U.S. Pat. No. 5,395,671, the entire substance of which is incorporated herein by reference, that a certain construction of a composite fabric, comprising multi-layers of high molecular weight woven and non-woven fabrics assembled in a particular manner, had unusual ability to stop the penetration of even very high energy projectiles, such as a very high energy projectile issuing from a 0.44 magnum bullet. This fabric comprised two independent layers of material. That is the two layers of material, each composed of a plurality of sub-layers, were not attached to each other. The side of the fabric facing in the direction from which the projectile is incoming is suitably made of multiple sub-layers or plies of non-woven fabric, comprising very high molecular weight polymer filaments. The side of the fabric disposed away from the incoming direction of the projectile, and toward the object in need of protection, is suitably made up of multiple sub-layers or plies of woven fabric, comprising high molecular weight polymer filaments, which woven sub-layers or plies have been quilted together. The fact that only the sub-layers or plies of the woven fabric are quilted together and the fact that the plies of non-woven fabric are disposed toward the incoming projectile are essential criteria of the invention of the '671 patent because it is the combination of these two elements which causes the finished composite fabric to have its unusual and unexpectedly effective stopping power.

Another recent development in this field is disclosed in U.S. Pat. No. 5,343,796. This patent describes a composite fabric protective system comprising an outer, or face, layer which has as its purpose to slow the velocity of the incoming projectile so that the second, underlayer, then can stop this now lower velocity projectile. According to this patent, the first, or face, layer is a pliable, cut resistant fibrous layer; and the second, or inside, layer is a pliable impact/ballistic energy absorbing fibrous layer. The '796 patent also alleges that the first and second layers can be reversed with the energy absorbing layer being the face layer and the cut resistant layer being the second layer. Three layer systems are also disclosed where the third layer is like the first layer.

Many different fibers and fiber combinations are disclosed in this reference and the entirety of this reference is therefore incorporated herein by reference. Any of these fibers and fiber combinations can be used in the practice of the instant invention.

The composite fabric of the '671 patent is an excellent protective material from which excellent protective garments are made. However, because this composite fabric was intended to stop a 240 grain 0.44 magnum bullet traveling at an impact velocity of 1450 feet per second, the fabric is necessarily fairly thick. It is made up many layers of both woven and non-woven sub-layers which have been assembled as aforesaid. Because this fabric has to have this exceptional stopping power, it is thus necessarily made up of these multiple layers of woven and non-woven fabrics. The requirement of this fabric that it stop a 0.44 magnum projectile, requires that there be a substantial number of layers of non-woven fabric in this composite. The use of such multiple layers of non-woven fabrics, made of high molecular weight polymer filaments, makes the fabric reasonably stiff and therefore less than ultimately comfortable to the wearer.

Despite the need for serious impact protection which is answered by the fabric of the '671 patent, this special fabric structure has been assembled at a rather low areal density of about 0.95 to 1.15 pounds per square foot. It has been found that with this special structure, it is possible to make up this composite fabric in such a low areal density and still stop a projectile from a 0.44 magnum bullet traveling at an impact velocity of 1,450 feet per second. This was most unusual at the time of its invention and has found some commercial success for body armor offering Level IIIA protection.

Stiff protective clothing, particularly such clothing which has a very tight weave or disposition of filaments, and even more particularly such clothing which comprises layers of non-woven fabric, has a degree of discomfort to the wearer in direct proportion to its areal density and its flexibility. For the same polymer filaments, it is axiomatic that the higher the areal density of the fabric, the greater is the stopping power of the fabric. It is also a fact that, for fabrics made up of the same filaments, the higher the areal density of a fabric, the stiffer it is because it has progressively fewer void spaces.

In modern protective clothing, a balance must be struck between the stopping power of the garment or fabric and the degree of discomfort the wearer is willing to put up with. If the fabric has too few filaments, or if the molecular weight and denier of the filaments making up the fabric is too low, or if the fabric is too thin, there will be insufficient protection afforded the wearer, and the fabric will not have achieved its purpose. The direction in which this art is going is consistent with the direction in which the power of guns is going. That is, with time, the impact velocity and penetrating power of ballistic projectiles has continued to increase, and therefore, the stopping power of protective garments has also increased. This has been accomplished by using stronger and higher molecular weight filaments, by increasing the weight and stiffness of the fabric, and by assembling the fabric from different elements, such as both woven and non-woven fabrics, which provide different, and cumulatively superiorly effective, kinds of stopping power. However, it is desired to lighten the fabric and make it less uncomfortable to the wearer, and still have it stop incoming ballistic projectiles.

OBJECTS AND BRIEF DESCRIPTION OF THE INVENTION

It is therefore an object of this invention to provide a lightweight, novel fabric which provides level IIA, level II and level II+ (level IIIA 9 mm sub-machine gun) stopping power, but yet has a very low areal density and is therefore more comfortable to wear.

Other and additional objects will become apparent from a consideration of this entire specification, including the claims appended hereto.

In accord with and fulfilling these objects, the composite protective fabric of this invention consists essentially of at least three successive layers of ballistic fabric arranged in a particular configuration. Specifically, the composite protective fabric of this invention comprises a first non-woven fabric outer, or face, layer, a woven fabric middle layer, and a second non-woven fabric inner layer.

The non-woven fabric inner and outer layers can be the same or different, and are each made up of a multiplicity of individual non-woven sub-layers. Each of these individual sub-layers is conventionally made up of resin bonded, substantially unidirectional non-woven ballistic fibers. These fibers and the resin bonded non-woven sub-plies are not novel to this invention, but are per se known. Instead of calling these sub-plies resin bonded non-woven sub-plies, it could also be appropriate to refer to these several sub-plies of resin bonded non-woven fabric as substantially unidirectional ballistic fiber reinforced resin. Suitably there are used between about 4 and 10 sub-plies of resin bonded substantially unidirectional non-woven fabric for each of the inner and outer layers, respectively of the composite fabric of this invention.

The woven fabric middle layer is made up of a multiplicity of woven individual sub-layers of conventional ballistic fibers (yarns). These sub-layers are suitably woven in a pattern which utilizes about 35 to 75 fibers (yarns) per inch in each direction. The weaves of the woven sub-layers may be the same or different, and any weave, whether known or new, is acceptable for use in this aspect of this invention. Each woven sub-ply may have the same number of fibers in each direction or a different number of fibers in each direction. Different woven sub-layers may have different numbers of fibers in each or both directions. Of particular merit are sub-fabrics having a 45×45 weave, or a 56×56 weave.

The multiplicity of woven sub-fabric layers which make up the essential middle layer of the composite fabric of this invention are maintained as individual layers and are not quilted or otherwise joined to each other throughout their entire area. However, it is considered to be within the scope of this invention to stabilize the plurality of woven sub-plies by tacking them together at various locations. Thus, this invention includes either tacking these sub-plies together or not as desired.

An essential characteristic of the multiple sub-fabrics used as the middle layer of the composite fabric of this invention is that at least a substantial number of the woven fabrics of the middle sub-plies are calendared. Calendaring of the sub-plies of woven fabric causes the fabric of the ply to flatten out. It also causes the individual fibers of the woven yarns, which make up the woven sub-fabric, to spread out and partially cover the gaps in the weave, This, thereby, causes the fibers of the woven yarns to actually cover a larger area. Put another way, calendaring of the woven sub-fabric forces some of the fibers in the woven yarns into the spaces between the main bodies of the yarns.

This puts more fiber in the way of the incoming ballistic projectile and gives the composite fabric greater stopping power while at the same time making it thinner and more flexible. It will be clear that the areal density of the calendared fabric is about the same as the areal density of the woven fabric before calendaring. Thus, by calendaring several sub-layers of woven fabric, greater stopping power is achieved at the same areal density and, because the fabric is thinner, with greater flexibility and wearability of the fabric. Conversely, for the same stopping power, a composite fabric assembled according to this invention will have a lower areal density and at least the same flexibility.

The composite non-woven/woven/non-woven fabric of this invention is suitably of low areal density. The areal density of these composite fabrics should be less than about 0.9 pound per square foot, preferably not more than 0.85 pound per square foot for composite fabrics which are intended to comply with Level II protection; and 0.7 pound per square foot for composite fabrics according to this invention which are intended to comply with level IIA protection. In one specific embodiment, the areal density of a composite fabric made up of five (5) sub-plies of resin bonded, unidirectional non-woven fabric for each of the inner and outer layers, and 30 sub-plies of woven, calendared fabric for the middle layer, had an areal density of 0.85 pound per square foot and yet withstood ballistic impact sufficient to pass the N.I.J Level IIIA test against a 9 mm sub-machine gun.

In another specific embodiment of this invention, the composite fabric was made up of, respectively, seven (7) sub-plies of resin bonded, unidirectional non-woven fabric for each of the inner and outer layers, and 16 sub-plies of woven, calendared fabric for the middle layer. This material had an areal density of 0.7 pound per square foot and was able to pass the N.I.J. Level IIA impact resistant test. Other examples of such low areal density, ballistic impact resistant composite fabrics according to this invention have 5 sub-plies of resin bonded, unidirectional non-woven fabric for each of the inner and outer layers, respectively, and 25 sub-plies of woven, calendared fabric for the middle layer; and 5 sub-plies of resin bonded, unidirectional non-woven fabric for each of the inner and outer layers, respectively, and 20 sub-plies of woven, calendared fabric for the middle layer.

Contrary to the state of the prior art, the fabrics of this invention provide a strike face which is each made up of elements which are least likely to open up and be penetrated. In the prior art, it has been conventional wisdom to provide the elements least likely to open up and be penetrated as the layer which is furthest from the point of initial impact, and closest to the body being protected. The theory was that putting lower penetration resistant layers as the strike face caused the incoming ballistic projectile to lose some of its energy breaking through these layers so that when it finally reached the layer which was least likely to open up and be penetrated, it had a lower energy level and was therefore more easily stopped. It was most unexpected that placing the strongest layer, that is the layer least likely to be penetrated, as the strike face would provide a highly flexible composite fabric with great stopping power which also was more comfortable to wear because it has a very low areal density.

It has now been found that using the material which is least likely to open up as the face layer, and, preferably as the inner layer as well, and sandwiching a special woven layer between these two inner and outer layers, produces a composite fabric which has excellent stopping power, much better stopping power in relation to the areal density than could reasonably have been expected from a consideration of the prior art. Thus, although the prior art generally teaches to place the element least likely to open up as the innermost layer of a composite protective fabric, and some portions of the prior art may hint at placing this element as the strike face, the prior art is silent on using a material which is least likely to open up as both the face layer and the inner layer.

DETAILED DESCRIPTION OF THIS INVENTION

According to this invention, the instant fabric consists essentially of a plurality of sub-plies of woven fabrics each sub-ply of which comprises a multiplicity of filaments or yarns of high molecular weight polymers, such as polyolefins or aramids, in a calendared woven structure. The use of other polymers is also within the scope of this invention. It is essential that, whichever polymers are used to make the filaments or yarns from which the instant composite fabric is made, they must have a minimum tensile modulus of about 160 grams/denier and a tenacity of at least about 7 grams per denier. The fibers used in forming the woven fabrics of this invention preferably have a minimum tensile modulus of 300 grams per denier and a tenacity of at least 15 grams per denier.

Different filament materials require somewhat different physical property minimum values in order to be useful in this invention. These properties are generally known and have been previously reported. Specific reference is made to U.S. Pat. No. 4,681,792, which describes different polymer filaments which are useful in this invention, The entire contents of this patent is hereby incorporated herein by reference.

Where polyethylene filaments are used, they preferably have a minimum weight average molecular weight of 500,000, a minimum tensile modulus of 500 grams per denier, a tenacity of at least 15 grams per denier, and an energy to break of at least about 22 joules per gram. It is preferred to use polyethylene filaments having molecular weights of at least 1,000,000, and more preferably at least 2,000,000. Where polypropylene filaments are used, for example, their weight average molecular weight should be at least about 750,000, preferably between about 1 and 4 million, and most preferably between about 1.5 and 2.5 million. These fibers should have a modulus of at least about 300 grams per denier, a tenacity of at least about 8 grams per denier, and an energy to break of at least about 22 joules per gram. Exemplary polyvinyl alcohol filaments have similar minimum properties to those recited above for polyethylene. Polyacrylonitrile, nylon, polyethylene terephthalate and aramid polymers are also examples of filament polymers which are useful in this invention at minimum physical properties which are similar to those which have been described above.

Using filaments of at least such minimum physical properties, sub-plies of woven fabric are made from such suitable filaments. The weaving can be of any conventional structure with a plain weave being preferred. Other weave structures are usable in this invention as well. These individual woven sub-plies are individually calendared and then a plurality of them stacked together to form the middle layer of the composite fabric of this invention. A plurality of ballistic fibers, yarns or filaments are suitably generally aligned, such as by carding for example, to make a tow or a felt. These may be needle punched or not as the case may be. The aligned fibers are then impregnated with a suitable resin to form a non-woven ply. These non-woven pies of resin bonded substantially unidirectional fibers are per se known and have been widely used in the protective garment technologies. After formation, two sets each of a plurality of the sub-plies, respectively, are stacked together to form a face layer and an inner layer, respectively, for use in the composite sandwich fabric of this invention. These stacks of a plurality of non-woven plies are then sandwiched around the plurality of calendared woven fabric sub-plies, and the assembly suitably joined to the fabric garment, such as for example an under garment or an outer garment. The joining of the composite protective fabric of this invention with the fabric garment is accomplished in an otherwise conventional manner such as for example by inserting the composite fabric into pre-sewn pockets in the garment.

This invention is directed to the composite fabric described above. It is also directed to the assembly of the composite fabric described above with a fabric garment or other fabric which does not itself offer protection against ballistic projectile penetration.

What is claimed is:

1. A composite fabric which prevents the complete penetration therethrough of a high energy projectile under conditions which are at least as stringent as an N.I.J. Level II and IIIA sub-machine gun penetration test comprising, in succession:

a first layer comprising a plurality of at least 4 sub-layers of resin bonded substantially unidirectionally aligned anti-ballistic fibers;

a middle, second layer comprising a plurality of individually calendared sub-layers of woven anti-ballistic fibers having a tensile modulus of at least about 160 grams per denier and a tenacity of at least about 7 grams per denier, wherein the weave of said woven sub-layers comprises at least about 35 yarns per inch in both directions of said weave; and a third layer comprising a plurality of at least 4 sub-layers of resin bonded substantially unidirectionally aligned anti-ballistic fibers;

wherein said composite fabric passes at least the N.I.J. Level II and IIIA sub-machine gun penetration test.

2. A composite fabric as claimed in claim 1 wherein said woven layers are not quilted together.

3. A composite fabric as claimed in claim 1 wherein said layers are not joined together.

4. A composite fabric as claimed in claim 1 wherein at least some of said layers are tacked together.

5. A composite fabric which prevents the complete penetration therethrough of a high energy projectile under conditions which are at least as stringent as an N.I.J Level IIA penetration test comprising:

a first layer comprising a plurality of at least about 4 sub-layers of resin bonded substantially unidirectionally aligned anti-ballistic fibers;

a middle, second layer comprising a plurality of individually calendared sub-layers of woven anti-ballistic fibers, wherein the yarns of said woven sub-layers have a tensile modulus of at least about 160 grams per denier and a tenacity of at least about 7 grams per denier, and wherein said woven sub-fabrics have at least about 35 yarns per inch in both directions of said weave; and a third layer comprising a plurality of sub-layers of resin bonded substantially unidirectionally aligned anti-ballistic fibers;

wherein said composite fabric has an areal density of not greater than about 0.7 pound per square foot and passes at least the N.I.J. Level IIA penetration test.

6. A composite fabric as claimed in claim 5 wherein said woven layers are not quilted together.

7. A composite fabric as claimed in claim 5 wherein said layers are not joined together.

8. A composite fabric as claimed in claim 5 wherein at least some of said layers are tacked together.

9. A combination of the composite fabric as claimed in claim 1 and a non-anti-ballistic fabric garment.

10. The combination as claimed in claim 9 wherein said composite fabric is located in sewn pockets in said non-anti-ballistic fabric garment.

11. A combination of the composite fabric as claimed in claim 5 and a non-anti-ballistic fabric garment.

12. The combination as claimed in claim 11 wherein said composite fabric is located in sewn pockets in said non-anti-ballistic fabric garment.

13. A composite fabric as claimed in claim 1 having an areal density of at most 0.85 pound per square foot.

* * * * *